US011028608B2

(12) United States Patent
Gerace

(10) Patent No.: US 11,028,608 B2
(45) Date of Patent: Jun. 8, 2021

(54) POOL CLEANING DEVICE

(71) Applicant: Aquatic Enterprises Pty Ltd., New South Wales (AU)

(72) Inventor: Connie Leeann Gerace, New South Wales (AU)

(73) Assignee: Aquatic Enterprises Pty Ltd., New South Wales (AU)

( * ) Notice: Subject to any disclaimer, the term of this patent is extended or adjusted under 35 U.S.C. 154(b) by 146 days.

(21) Appl. No.: 16/476,407

(22) PCT Filed: Feb. 14, 2018

(86) PCT No.: PCT/AU2018/050113
§ 371 (c)(1),
(2) Date: Jul. 8, 2019

(87) PCT Pub. No.: WO2018/148791
PCT Pub. Date: Aug. 23, 2018

(65) Prior Publication Data

US 2020/0048922 A1 Feb. 13, 2020

(30) Foreign Application Priority Data

Feb. 16, 2017 (AU) ..... 2017900503

(51) Int. Cl.
*E04H 4/16* (2006.01)
*A47L 13/256* (2006.01)
(Continued)

(52) U.S. Cl.
CPC ..... *E04H 4/1609* (2013.01); *A47L 13/255* (2013.01); *A47L 13/256* (2013.01); *A47L 13/258* (2013.01)

(58) Field of Classification Search
CPC ..... A47L 13/20; A47L 13/24; A47L 13/25; A47L 13/252; A47L 13/253;
(Continued)

(56) References Cited

U.S. PATENT DOCUMENTS 1,437,789 A 12/1922 Whyte
1,648,809 A * 11/1927 Hillyard ..... A47L 13/255 15/229.4
3,085,271 A * 4/1963 Janssen ..... A47L 13/253 15/147.2
(Continued)

FOREIGN PATENT DOCUMENTS

DE 2551678 * 6/1977
DE 2611615 * 9/1977
(Continued)

OTHER PUBLICATIONS

International Search Report dated Apr. 10, 2018, Application No. PCT/AU2018/050113.

*Primary Examiner* — Mark Spisich
(74) *Attorney, Agent, or Firm* — The Dobrusin Law Firm, PC

(57) ABSTRACT

A device for cleaning a swimming pool comprising a base member. The base member having a first base portion and a second base portion. A socket disposed on the base member, and the first base portion the and second base portion each respectively having a hinge end and a distal end. The second base portion hinge end is attached to the first base portion hinge end forming a hinge of the base member. A microfibre cloth removably mountable to the base member; and wherein the second base portion is configured to move between a first position and a second position, in which the first position is an operating position and the second position is a cloth removal position.

19 Claims, 3 Drawing Sheets

(51) Int. Cl.
*A47L 13/258* (2006.01)
*A47L 13/255* (2006.01)

(58) Field of Classification Search
CPC .... A47L 13/254; A47L 13/255; A47L 13/256; A47L 13/258; E04H 4/1609
USPC ..... 15/147.1, 147.2, 228, 229.1–229.9
See application file for complete search history.

(56) References Cited

U.S. PATENT DOCUMENTS 3,162,879 A * 12/1964 Smyth ..... A47L 13/253 15/147.2
3,304,567 A * 2/1967 Sturm ..... A47L 13/253 15/147.2
3,324,495 A * 6/1967 Van Schwartz ..... A47L 13/253 15/147.2
4,680,826 A * 7/1987 Schunter ..... A47L 13/258 15/147.1
2002/0152569 A1* 10/2002 Zorzo ..... A47L 13/258 15/147.1
2005/0044649 A1* 3/2005 Kresse ..... A47L 13/20 15/228
2006/0059640 A1 3/2006 Hornsby et al.
2007/0061987 A1* 3/2007 Kresse ..... A47L 13/20 15/228
2008/0168614 A1* 7/2008 Guohua ..... A47L 13/255 15/228
2008/0222825 A1* 9/2008 Sampaio ..... A47L 13/252 15/229.8
2013/0212822 A1 8/2013 Libman et al.
2015/0059804 A1 3/2015 Bergez
2015/0223663 A1* 8/2015 Maurer ..... A47L 13/20 134/6

FOREIGN PATENT DOCUMENTS

EP 2428150 B1 10/2014
JP 2005-237587 * 9/2005
NL 1002625 * 7/1996

* cited by examiner

POOL CLEANING DEVICE

TECHNICAL FIELD

The present invention relates to a cleaning device for use in a submerged environment. More particularly, the device of the present invention may relate to swimming pool cleaning equipment such as a microfiber (microfibre) pool broom head.

BACKGROUND

Conventional pool brooms comprise a nylon brush rigidly attached to the end of an extendible pole. The brushes act to dislodge dirt, algae and the like from the walls and floor of the pool to be collected by the filtration system or to be vacuumed up after resettling on the pool floor. Whilst this may ultimately achieve a clean pool, it comes at the expense of gradually clogging the pool filtration system and often the need to vacuum the pool.

The known brushes, such as nylon bristle type brushes, are usually very wide laterally but narrow in the direction of sweeping and being rigidly attached to the pole they are difficult to manoeuvre, particularly in corners, on walls and on the steps of a pool. This limits their effectiveness, particularly in modern pools which may have many contours.

Residential swimming pools are popular for family and recreational relaxation, particularly in the warmer climates and can lend themselves to heavy usage during warm and hot weather. To protect against contamination and spread of bacteria and the like, the walls of the pools must be cleaned regularly, usually with cleaning solutions applied by mechanical devices such as sprays or brushes. Pool brushes typically incorporate and array of bristles with distal ends intended to follow the contour of the pool walls to provide for application of the solutions and dislodging of deposits and growth clinging to the wall surfaces. Modern day pools often take numerous different shapes, including generally rectangular horizontal cross section shapes, kidney shapes and compound contours dictated by the whim of the architect or pool designer. Many such pools are lined with plaster and incorporate within their walls, sharp or curved corners, ridges, crevices, risers and, depressions and the like which must be cleaned regularly to maintain a sanitary and attractive pool appearance.

However, common problems are typically that these brooms are only useful for some surfaces and surface shapes. Damage to surfaces is a common issue with known broom devices as bristles can scratch pool surfaces or are insufficient to effectively clean surfaces due to contact issues between the broom cleaning elements, such as bristles, or may be of a shape which cannot form a suitable contact in curved surfaces. In addition, cleaning with these devices may require a considerable amount to effort to scrub a surface clean.

In this regard, typically, a brush of some significant lateral span is desired for the planer walls of the pool for efficient and rapid cleaning thereof in a broad swath as the brush is drawn there over. Brushes of this configuration do not function well to follow the contours and irregularities in ridges and crevices formed in the walls thus often making it necessary for the workman to utilize different configurations of brushes, one of a wider span for cleaning the planer and large area walls and the like and especially configured smaller brushes to access the irregular surfaces in crevices, ridges and ribs which would otherwise often be left untouched or inadequately cleaned. Thus, those working in the pool cleaning business have been left with the choice of either utilizing multiple brushes of different configurations for achieving the entire pool cleaning process or consuming inordinate time cleaning the large area surfaces with smaller specially contoured brushes and/or utilizing a large area brush and leaving the contoured areas inadequately cleaned.

Cleaning tools of different configurations have been proposed for various different cleaning applications. However, these devices remain inefficient to clean pools or other devices effectively.

For floor brooms it has been proposed to construct a broom with a back member flared upwardly and outwardly at the laterally opposite ends and formed of multiple components for trapping single component rubber bristles of different configuration therein to flare outwardly for access to corners between the floor and room wall. Such a device is shown in U.S. Pat. No. 6,108,854 (Dingert). Such devices, while affording access to dust and cob webs along corners of a room floor, are configured with the rubber teeth so widely spaced and of such irregular density at the distal ends as to have no practicality for pool or deck cleaning itself. Further, pool sterilising agents such as salt or chlorine may destroy the brush, or the integrity of the brush as they are typically only used in controlled indoor environments and with known chemicals, or only tap water.

A further known cleaning device is disclosed in EP 2428150 B1 (Edlmair Kunststofftechnik GMBH et al) which discloses a cleaning head with a textile part which he textile part is made of natural fibers, artificial fibers, micro-fibers, mineral fibers, coated fibers, hardened fibers or blended fabric of fibers. This device however, is used for suction cleaning.

US 2015/0059804 A1 (Bergez) discloses a cleaning implement with an abrasive component and an absorbent component bound together. The absorbent component comprises a microfiber fabric. The abrasive component is crocheted from a polyester yarn with embedded abrasive particles such as metallic fibers. The cleaning implement may be manufactured in a wide variety of shapes, colors, sizes, and configurations to meet task-specific needs or personal preference. These devices would not be sufficient to use on pool surfaces due to the abrasive component being likely to cause damage.

A cleaning device with a vibration means US 2006/0059640 A1 (Hornsby et al). As the device requires mechanical moving parts in operation, this device is not suitable for use in submerged environments.

Another cleaning device is disclosed in U.S. Pat. No. 1,437,789 A (Whyte). This device is a broom device which has an offset handle relative to the centre of the broom head. This device may be suitable for cleaning flat surfaces but has a specific operational use due to the offset handle.

A mop head is disclosed in US 2013/0212822 A1 (Libman et al) with a securing element to attach a cleaning surface. This device is generally suitable for cleaning flat surfaces, such as kitchen tiles.

The object of this invention is to provide pool broom head to alleviate the above problems, or at least provide the public with a useful alternative.

Any discussion of the prior art throughout the specification should in no way be considered as an admission that such prior art is widely known or forms part of common general knowledge in the field.

SUMMARY

Problems to be Solved

It may be advantageous to provide for a device to clean a fibreglass surface.

It may be advantageous to provide for a cleaning device which may reduce the potential for damage to a structure in use.

It may be advantageous to provide for a device which is relatively more easy to manoeuvre in use.

It may be advantageous to provide a device which may be more easily manoeuvrable in a submerged environment or partially submerged environment.

It may be advantageous to provide for a cleaning device with a cleaning surface which can be removed and replaced/maintained for further cleaning uses.

It may be advantageous to provide for a device which reduces the potential for contaminants to be dispersed after being dislodged or agitated in a fluid.

It is an object of the present invention to overcome or ameliorate at least one of the disadvantages of the prior art, or to provide a useful alternative.

Means for Solving the Problem

In a first aspect of the invention there is provided a device for cleaning a swimming pool. The device preferably comprising a base member, the base member having a first base portion and a second base portion and a socket disposed on the base member. The first base portion the and second base portion may each respectively having a hinge end and a distal end. The second base portion hinge end may be attached to the first base portion hinge end forming a hinge of the base member. A microfiber cloth may be removably mountable to the base member; and wherein the second base portion may be configured to move between a first position and a second position, in which the first position may be an operating position and the second position may be a cloth removal position.

Preferably, the base member comprises an array of apertures. Preferably, the hinge ends are offset relative to the socket. Preferably, the microfiber cloth may be releasably secured to the base member via a tab passing between the socket and the base. Preferably, the tab further comprises at least one of; a buckle and hook and loop fasteners. Preferably, the second base portion may be restricted to rotating in a direction toward the contact surface. Preferably, the distal end of at least one of the first base portion and the second base portion may be curved upwardly. Preferably, the at least one distal end curved upwardly fits the contours of a swimming pool. Preferably, the base may comprise a locking means to retain the base in the first position.

Preferably, the microfiber cloth comprises a plurality of microfiber tufts. Preferably, the microfiber cloth may comprise a pocket adapted to receive a distal end of the base member. Preferably, a handle is disposed on the second base portion to actuate the hinge. Preferably, the socket is adapted to receive a pole. Preferably, the socket may be pivotally attached to the base member pole. Preferably, the socket may be attached to the first base portion.

In the context of the present invention, the words "comprise", "comprising" and the like are to be construed in their inclusive, as opposed to their exclusive, sense, that is in the sense of "including, but not limited to".

The invention is to be interpreted with reference to the at least one of the technical problems described or affiliated with the background art. The present aims to solve or ameliorate at least one of the technical problems and this may result in one or more advantageous effects as defined by this specification and described in detail with reference to the preferred embodiments of the present invention.

DESCRIPTION OF THE INVENTION

Preferred embodiments of the invention will now be described with reference to the accompanying drawings and non-limiting examples.

The present disclosure is directed towards a cleaning device 10 for cleaning swimming pools and submerged environment surfaces. The device may also be suitable for use in any desired cleaning application, such as washing windows and/or floor cleaning. The device 10 may have particular advantage when used with smooth surface, or fibreglass pools.

Commonly, below and above ground pools are common in many family homes and serve as important entertainment focal points. Moisture and humidity of pools may cause growth of algae and other organisms, and therefore must be cleaned regularly to maintain sanitary conditions and pleasing aesthetics. Typically, pools have walls which are generally planer or gently rounded but then come together at corners which may be rounded or squared off forming contours which may be relatively inaccessible by many pool cleaning brushes without risking damage to the adjacent pool wall. Further, pools are often lined with a relatively soft plaster or vinyl liner which, when contacted by a hard brush back during vigorous cleaning activity is subject to ready damage or tearing thus leading to costly repairs.

It will be appreciated that while reference is made to cleaning a "swimming pool", other submerged environments and articles may also be cleaned by the device. Further, the device may be adapted for use in a dry environment, or a non-submerged environment.

Figure 1:
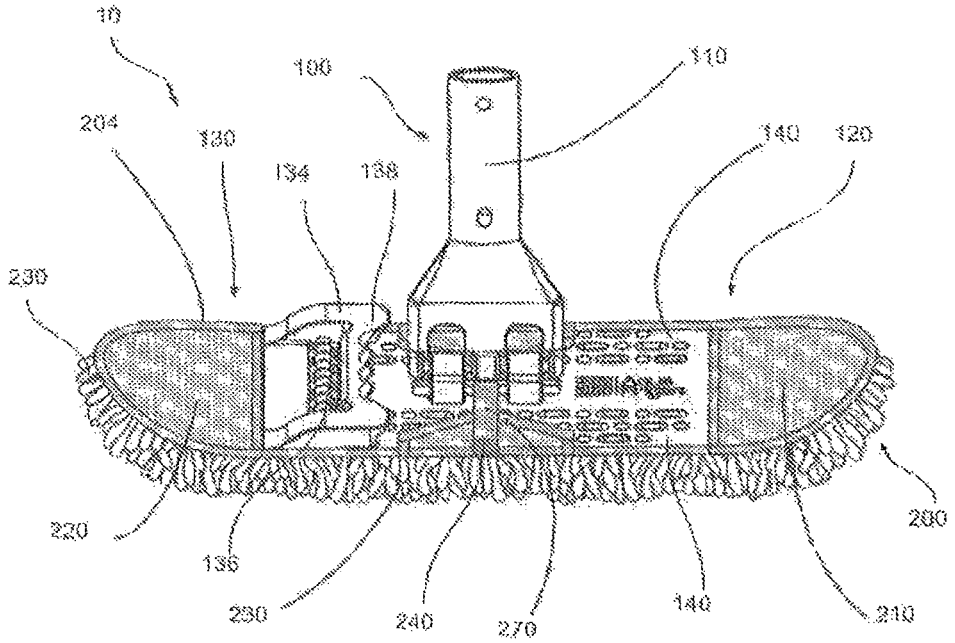
FIG. 1 illustrates a front view of an embodiment of a cleaning device with a microfiber cloth material mounted thereon.
Figure 2:
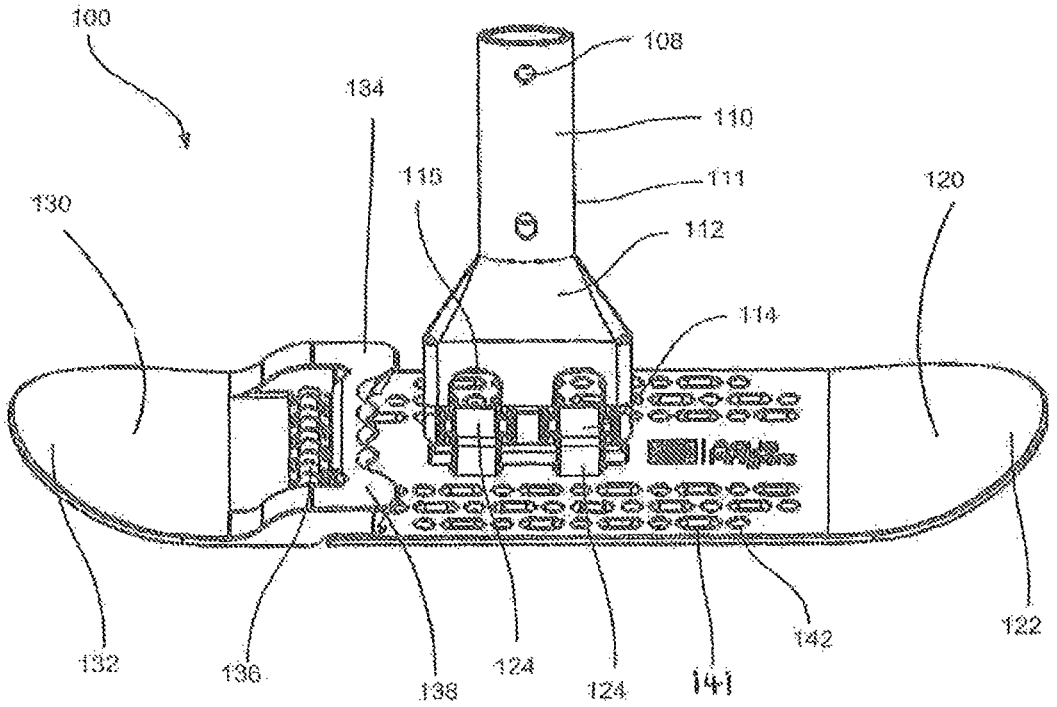
FIG. 2 illustrates a front view of an embodiment of the cleaning device of FIG. 1 without a microfiber cloth.
Figure 3:
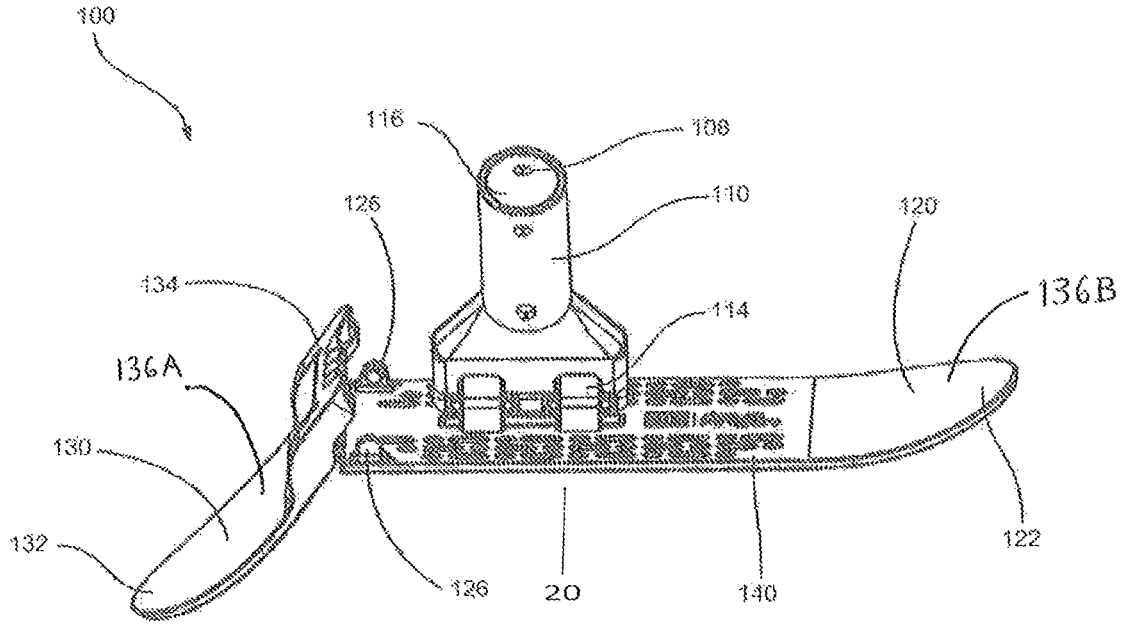
FIG. 3 illustrates a front view of an embodiment of the FIG. 1 in a fitting configuration in which a cleaning material can be mounted onto the cleaning surface of the device.

FIG. 1 shows an embodiment of a device for cleaning a swimming pool. The cleaning device 10 having a head portion 100 with a cloth portion 200. The head portion comprises a base portion 104 and a socket portion 110. The base portion is shown as having a first base portion 120 and a second base portion 130. The second base portion 130 being hingedly connected to the first base portion 120. The socket 110 being mounted to the base member 104. Preferably, the socket 110 is hingedly attached to the base member 104, and may be removable from the base member 104. The socket 110 may pivot, swivel or otherwise move relative to the base member 104 such that manoeuvring the head portion may be less strenuous in use. In an alternative embodiment, the socket 110 may be fixed to the base member 104, or the socket 110 may be integrally formed with the base member 104. The socket 110 may also be fixed to moving relative to the base member 104 in a single plane or two planes.

The socket 110 preferably has a tube or channel 116 which can accept an elongate element, such as a broom handle or handle element (not shown) for use with the device. The socket 110 may also have at least one aperture 108 adapted to receive a securing means (not shown), such as a screw or nail. A securing means may be used to secure the handle element to the socket 110. The upper socket portion 111 may comprise the channel 116 and the apertures 108, and the lower socket portion 112 may extend from the upper socket portion 111 towards the base. The upper socket 111 portion may be referred to as a distal end of the socket 110 and the lower socket portion 112 may be referred to as the proximal end of the socket 110. The lower socket portion 112 may be relatively wider than the upper socket portion 111 and may also be the termination portion of the channel 116 (i.e. the channel may end at the lower socket portion 112). The lower socket portion 112 may have a hinge portion 114 to be connected to a corresponding socket hinge portion of the base portion 104. The hinge portion 114 of the socket 110 may have an integral connection rail, or a pin may be received to act as a fulcrum point. The lower portion 112 may be formed with a plurality of arches or formations 115 which may receive a tooth or protrusion of the corresponding socket hinge portion of the base member 104. A strap or portion of the cloth 200 may be fed between the base member 104 and the socket lower portion 112 as is illustrated in FIG. 1.

In yet another embodiment, the channel 116 may have a thread or other securing means to attach a pole or broom handle. The apertures 108 of the socket 110 may also be adapted to receive a pin, or depressible button on the broom handle. Optionally, the pole or broom handle is of a diameter which is the same as or smaller than the cross-sectional area of the channel 116 of the socket 110. However, in one embodiment the diameter of the handle is 0.1 mm to 5 mm large than the cross-sectional area of the channel 116 and the handle is forced into the channel 116 to be retained therein by friction.

The corresponding socket hinge portion 124 (also referred to herein as a "protrusion") of the base member 104 may be a C-hinge 124 or a claw type hinge, in which the C-hinge 124 grips the hinge portion 114 of the socket 110. The corresponding hinge 124 is preferably resiliently biased and/or flexible. In an alternate embodiment, the protrusion 124 comprises an aperture which receives a pin. In this alternative embodiment, the hinge is similar to that of a buti hinge.

The base portion 104 comprises a plurality of apertures 140. The apertures 140 may be localised to a central portion of the base member 104. The localisation of the apertures 140 may allow for fluids to pass through the apertures during use while improving the guidance of the device in use, which may reduce the potential for strain injuries of the user. The apertures 140 may be disposed in a predetermined array. The array may comprise varying sizes of apertures 141, 142. Elongate apertures 141 and circular apertures 142 may also be formed in the base portion 104. The apertures 140 are preferably rounded such that movement of the device 10 in a submerged environment may allow fluid movement of the device and reduce resistance experienced when submerged, for example when moving the device 10 through water. The apertures 140 may be disposed in any predetermined pattern or configuration. While only the first base portion is illustrated as having apertures 140, the apertures 140 may be disposed on any part of the base member 104.

The distal portions of the first base portion 120 second base portion 130 may be upturned relative to the contact surface 20 of the head. The contact surface 20 of the head is the side in which the material 200, such as a microfiber cloth, is mounted and contacts a surface to be cleaned. The distal portions 122, 132 of the base member 104 are preferably rounded or contoured to allow for easier movement in a submerged environment. Any predetermined shapes may be used for the base member 104. Optionally, the base member 104 is tapered or formed with varying thicknesses.

A handle portion 134 is disposed on the second base portion 130. Contours 138 can be disposed on the handle which may improve the grip of the user moving the handle 134 from a first position to a second position. Finger contours 138 are shown in FIGS. 1, 2, 3 and 5 and may assist with gripping the handle 134. The handle 134 may extend from the second base portion relatively upward and towards the socket 110. The handle 134 may be integrally formed with the second base portion 130, or may be attached to the base portion and/or may be removably attached therewith. The handle 134 may be formed as a solid or may be hollow with reinforcing or support structured formed within the hollow structure. The handle 134 may also partially cover or conceal the hinge 136 of the base member 104 to reduce the potential or inadvertent movement of the second base portion 130 or damage to be caused to the hinge 136.

Respective ends of the first base portion 120 and the second base portion 130 are connected at the base hinge 136. Rotation of the second base portion 130 relative to the first base portion 120 is preferably in the direction of the contact surface 20. In this way the cloth 200 can be mounted on the head portion 100 and removed from the head portion 100. The upturned distal portions of the base member 104 allows for pockets 210, 220 of the cloth portion 200 to be mounted thereon. The base member may be arcuate to allow for contours of surfaces to be cleaned.

The hinge 136 may be formed from hinge ends of the base member portions 120, 130. The hinge ends 136A, 136B of the base portions 120, 130 are the ends of each respective portion 120, 130 which are opposed to the distal ends 122, 132, respectively. Hinge ends are preferably integrally formed with each respective base portion 120, 130 such that in use the structural integrity of the base member is likely to be sufficient to allow for impacts and drops of the device head without damage. Hinge portions 136A, 136B can also be loops which receive an elongate hinge rod (not shown). The hinge 136 may be similar to the hinge between the socket 110 and the base member 104. In one embodiment, the first portion 120 comprises hinge end 136A and the second base portion 130 comprises hinge end 136B, with hinge end 136A having a plurality of mounting elements to allow for mounting of hinge end 136B.

Figure 4A:
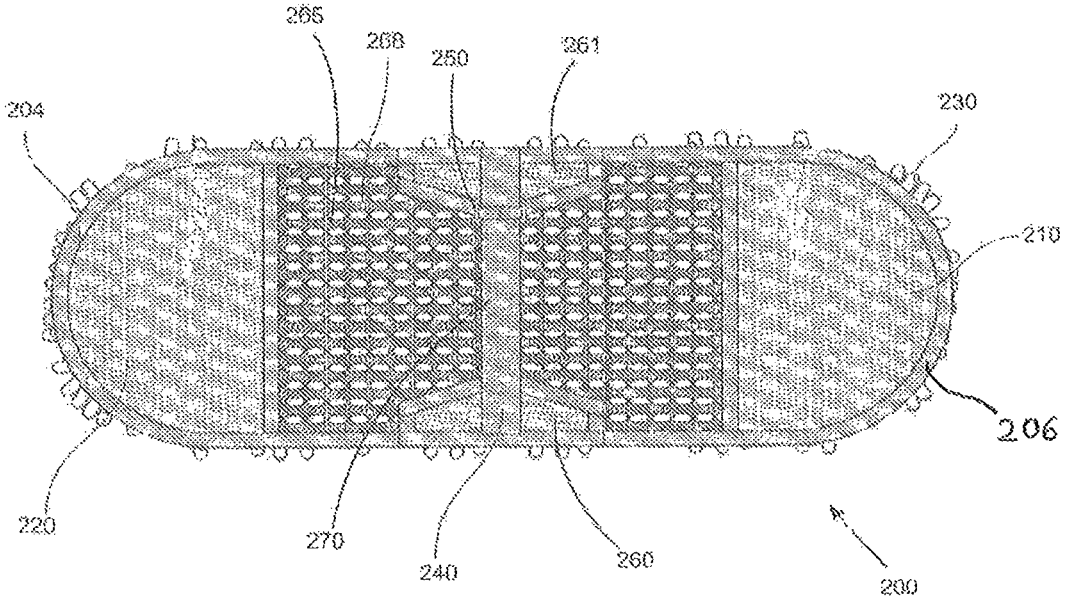
FIG. 4A illustrates a top view of an embodiment of a microfiber cloth which may be mounted on a cleaning device.
Figure 4B:
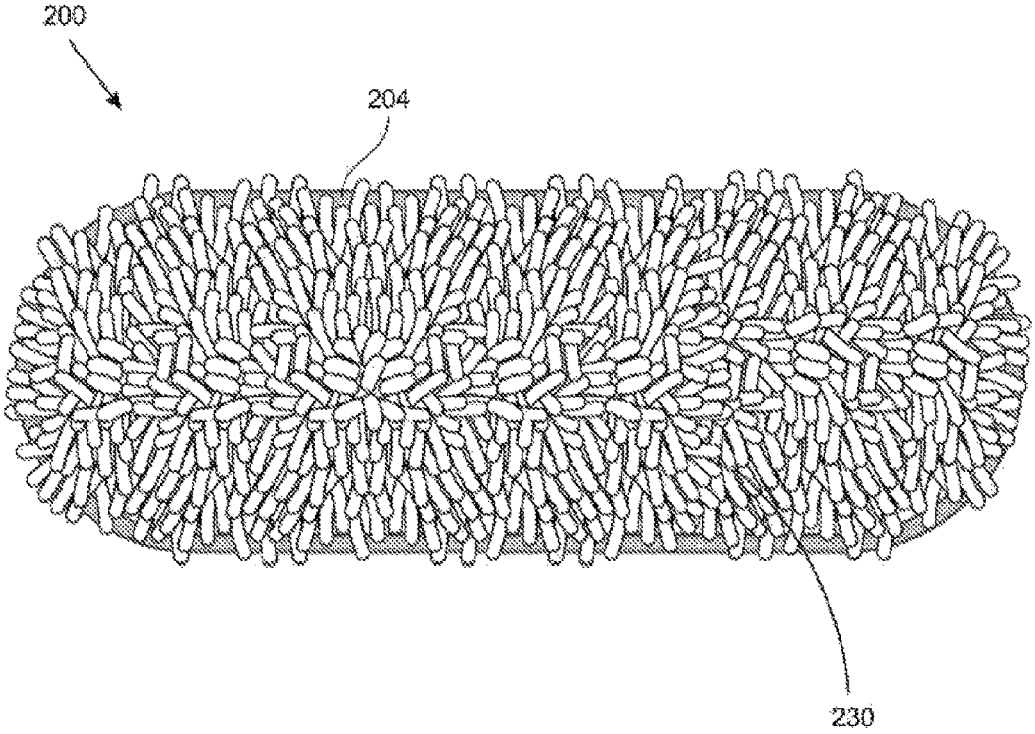
FIG. 4B illustrates a bottom view of an embodiment of a microfiber cloth which may be mounted on a cleaning device.

Referring to FIGS. 4A and 4B there is shown an embodiment of the cloth portion 200. The pockets 210, 220 of the cloth portion 200 may be made from an elastomeric material to allow for the pockets to be mounted onto the upturned portions of the base member 104. The pockets receive the upturned portions, such that when the base member 104 is in the first position the upturned portions retain the cloth portion 200 in a stretched position.

Mounting tabs 260, 261 may carry a strap 270 or other securing means. The strap 270 may be fitted with a buckle 250 or other fastening means. A hook and loop fastening means or a button may also be suitable for use with the strap. If there are two portions to the strap, at least one strap portion 270 is disposed on each of the mounting tabs 260, 261. In another embodiment, the mounting tab 260 carries the strap 270 and the second mounting tab 261 carries a fastening means, such as a hook and/or loop fastener or a buckle. Preferably, any fastening means are suitable for use in submerged conditions, and are therefore preferably formed from a noncorrosive material, such as a polymer or synthetic material. The strap 270, or strap portions 270 may be sewn or fixed on the mounting tabs 260, 261.

The tufts 230 may be embedded or fixed to a cloth surface material 265. The cloth surface material 265 may be formed with a plurality of holes to 268 to receive the tufts 230. Alternatively, the tufts are threaded through the cloth surface material 265 and secured thereto. Tufts 230 may be effective for cleaning smooth surfaces, such as fibreglass pools as the tufts may contact a portion of the smooth surface and the gaps between the tufts 230 are used to capture dirt or other unclean matter while still effectively cleaning. In contrast, flat cloths may be used to clean, but are very likely to smear unclean matter, or move and disperse the unclean matter into a fluid, such as water in a swimming pool.

A rib or reinforcement means 204 may be disposed at the perimeter of the cloth portion 200. The pockets 210, 220 may be fixed to the cloth surface material 265 by the reinforcement means 204. The pockets may be hemmed at its periphery 204, 206. The reinforcement means 204 maybe a hem or other finishing method to secure two pieces of material together or prevent material from unravelling.

A plurality of material tufts 230 are illustrated on the contact side of the cloth portion 200. Tufts 230 may be formed from any desired fibrous material, such as microfiber, cotton or any other desired material. Microfiber materials may further have the advantage of reducing or limiting the growth of algae and/or microorganisms which are commonly found in residential pools. The fibrous material may be washable, synthetic or have any other desired properties. The cloth portion 200 may be formed with a plurality of materials, and may be stitched, or fixed together with an adhesive. In an exemplary embodiment, the tufts are microfiber with a tuft length in the range of between 1 cm to 5 cm. Preferably, the tuft length is around 2.5 cm to 3 cm in length with tufts being of a generally uniform length and diameter. The diameter of the tufts are preferably in the range of 5 mm to 15 mm. Tufts are advantageous to use in submerged conditions as the amount of material which can be collected is substantially larger relative to a standard microfiber cloth without tufts as the increased surface area of the tufts allows for greater trapping, as well as more use without replacement or washing of the cloth portion 200. Further, dirt or other materials dislodged from a surface are more likely to be trapped within the tufts than be dispersed into the water or other submerged environment. As such, there is a substantially reduced potential for algae or other microorganism blooms to occur as quickly due to the use of tufts.

The tufts 230 may be flexible finger-like projections formed from microfiber. These tufts 230 may be significantly superior to conventional cleaning devices as they can be firmly pressed against a surface to be cleaned without damage. Further, water or other fluids may be allowed to pass through the tufts 230 but tufts will trap dirt and/or microorganisms as fluid passes through. In addition, negative effects with respect to pressure differentials may be reduced as fluid passing through the tufts 230 will decrease lift of the contact surface of the head as fluid passing over the rear of the head and under the contact surface will be relatively more equal, therefore the device 10 may take advantage of the Bernoulli Principle to reduce the difficulty of cleaning, particularly in a submerged environment. This is typically not the case with conventional cleaning devices, generally as they have rigid cleaning bristles or a flat contact surface.

Microfiber cloths may be made from any desirable composition of polyamide (PA) and polyester (PE). Common polyamides may include at least one of nylon, Kevlar™, Nomex, trogamide. In another embodiment, the microfiber may comprise polyester, polyamide, and polypropylene. Preferably, the composition of the microfiber is selected from the group of; approximately 50% PA and 50% PE, approximately 60% PA and 40% PE, approximately 70% PA and 30% PE, 40% PA and 60% PE, 30% PA and 70% PE, 20% PA and 80% PE, or any other desired composition. The surface density of the microfiber may be in the range of 200 $g/m^2$ to 250 $g/m^2$, or 250 $g/m^2$ to 400 $g/m^2$, or in the range of 400 $g/m^2$ to 1,000 $g/m^2$ or any other desired surface density.

Optionally, neoprene or another similar material may be used to form a portion of the cloth 200 which may perform well under submerged conditions or conditions which are frequently or infrequently experienced by the device when in use.

Preferably, the cloth portion 200 is porous or otherwise formed such that fluid may to pass through the cloth portion 200 and the apertures 140 of the base portion 104. This allows for improved manoeuvrability of the device 10 when in use in a submerged environment. The pockets 210, 220 may be formed from a mesh or other material which allows fluid to easily pass there through. Optionally, the pockets may be formed from rubber, silicone, latex or lycra such that there is a relatively high friction between the pocket and the upturned portions of the base member 104.

Figure 5:
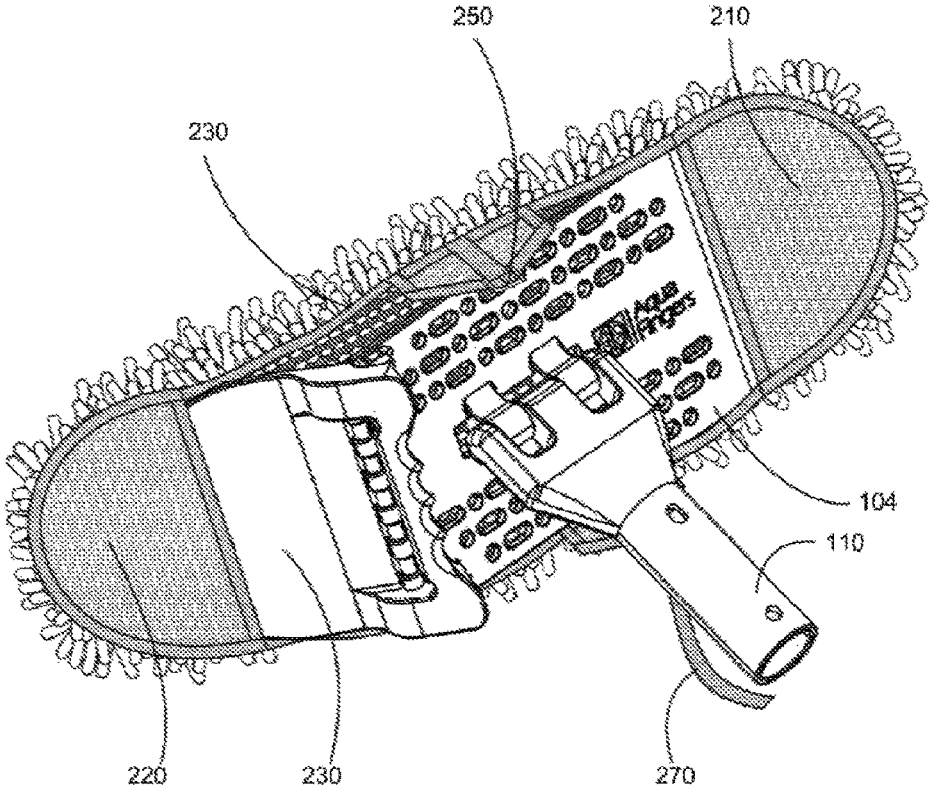
FIG. 5 illustrates a perspective view of an embodiment of a cleaning device with a microfiber cloth material mounted thereon.

As shown in FIG. 5, there is illustrated an embodiment of a device 10 in which the cloth portion 200 is being removed from the head portion 100 or mounted to the head portion 100. The second base portion 130 is between a first portion and a second position. The first position being an operable position, and the second position being an extreme rotation position of the second base portion 130 relative to the first base portion 120. Preferably, the second position positions the second base portion approximately perpendicular to the first base portion 120.

In one embodiment, if the second base portion 130 is rotated further than the extreme rotation position (second position), the second base portion 130 may be disconnected or removed from the first base portion 120. If the device 10 is adapted to allow for separation of the first base portion 120 and the second base portion 130, the separation may occur when the second portion 130 exceeds a potion which is perpendicular to the first base portion 120. It is preferred that the second base portion 130 does not move relatively upward.

A retaining means 126 may be disposed on the first base portion 120 which retains the second portion 130 in the first position. Snap locks may be sufficient for use as retaining means 126. Preferably, at least two retaining means are disposed on the first base portion 120 to engage with the handle 134 or with a corresponding retaining means of the second base portion 130. The retaining means may be a friction lock or a tongue in groove type lock, or protrusion in recess lock. Corresponding retaining means of the handle may be on the inner side of the handle 134 of the second portion. In an unillustrated embodiment, the second portion may be released from the first position by a press button. The press button may retract or otherwise move a flange or element to allow for the second base portion 130 to move relative to the first base portion 120.

The contact surface of the base member 104 is preferably flat or linear with the distal ends of the base member upturned. This configuration may be used for devices with a single base member 104 or more than two base member portions. Optionally, the base member (not shown) is formed with three base member portions in which the base member side with upturned portions can be deflected or moved downwardly relative to a central portion of the base member 104. Optionally, the upturned portions may also be formed with apertures or another desirable formation. The base member 104 may be formed with any desired texture, such as undulations, recesses, apertures, bumps, ridges, texture patterns, textures or any other desired feature. These textures may assist with cleaning when the contact surface 20 is in contact with a surface to be cleaned. It will be appreciated that the contact surface may is the underside of the head, and optionally includes the cloth portion 200.

In yet another embodiment, the contact surface textures may be used directly on the surface to be cleaned and may be used to clean off more stubborn materials which the cloth portion 200 may be not as suitable for.

In alternative unillustrated embodiments, the base member 104 is a single integral member and the cloth portion 200 is attached to the head portion via rails, clamped onto the head portion 100, or the rear side of the cloth (non-contract surface) comprises partially removable or fully removable attachment means, such as a hook and loop fastener portion, or hook and loop pads. If a hook and loop fastener portion is used, it is preferred that the base member 104 has the hook portion and the cloth portion 200 has a loop portion, however these may be arranged in any desired manner or configuration. If the cloth portion 200 has rails or is adapted to be fit onto rails, the head portion will have a corresponding rail segment. Corresponding rail segments may be disposed on the periphery of the head portion 100, and the rails of the cloth portion 200 are disposed near to the periphery of the cloth and preferably stretch the cloth portion, or make the cloth portion taut for use. If the cloth portion is to be clamped, clamps may be disposed on the rear surface of the base member 104.

In a further embodiment, the head portion 100 is preferably flexibly attached to a conventional pole to allow for greater manoeuvrability and thus easier cleaning than with traditional brushes. The head may be pivotally attached with the socket 110. The socket may be adapted to move in multiple axes to allow for a wider range of movements when in use. At least one axis direction may optionally be locked by a user with a locking means (not shown).

The base member 104 may be any predetermined or desired shape. The desired shape may be ovoid, a rounded rectangle, a rectangle, a square, a circle, an irregular shape, or any other desired shape. Most preferred, are rounded distal ends 120, 132 as this may allow for cleaning of contours of a swimming pool.

Cover portion 200 has a top side and a bottom side, in which bottom side comprises tufts of microfiber material 230 for trapping dirt and the top side comprises a backing for the microfiber cloth and pockets 210,220 for holding the cloth portion 200 to the head portion 100. A hook and loop tab 240 may assist with securing the cover portion 200.

The upturned end 122 of the first base portion 120 is first inserted into the first pocket 210 of the cloth portion 200. With the second base portion 130 being in the second position or near to the second position, the upturned end 132 of the second base member portion 130 end is inserted into the second pocket 220. Once both upturned ends 122, 132 are received within respective pockets of the cloth portion 200 the second base portion 130 can be moved into the first position. When the base member is moving to the first position the upturned ends move toward the distal ends of the pockets and stretch the cloth portion 200 to a fitted configuration. The fitted configuration preferably does not allow significant lateral or longitudinal movement of the cloth portion 200 such that it may be effective when used for cleaning. In the fitted configuration the upturned ends may be fully entered into the pockets. Finally the strap be passed between the base 104 and the socket 110 and then secured as seen in FIG. 1.

In one embodiment, the base member 104 is preferably made from injection moulded ABS components, providing suitable resilience to allow the various components to snap together and produce functioning hinges. Functioning hinges may be seen where the first and second base portions are connected, and where the socket 110 and base member 104 are connected. Further, snap locks or other retaining means may benefit from a resilient material such that damage in use or during movement is minimised.

The head portion of the device 10 may be formed from any predetermined material, such as a polymer, metal, metal alloy, composite material, rubber, wood, any injection mouldable material, or a combination of at least two of the preceding. Metals may include any stable metal on the periodic table which can retain a desired shape at least in ambient temperature. A metal alloy may include a combination of two or more materials with at least one of the two or more materials being a metal, such as zincalume, stainless steel, steel, brass, or any other desired alloy. However, due to the environmental conditions the device is preferably formed form a polymer, such as Low-density polyethylene (LDPE), High-density polyethylene (HDPE), Polypropylene (PP), Polystyrene (PS), Polytetrafluoroethylene (PTFE), Polyvinylchloride (PVC), Polychlorotrifluoroethylene (PCTFE), polyethylene terephthalate (PET) or any other desirable polymer. A composite material may be any material which consists of a matrix with reinforcement, such as carbon fibre (fiber), reinforced plastics, plywood, Bakelite, fibreglass or any other known composite material. Rubber or rubber derivative may also be used. The listed materials are exemplary only, and any other materials not listed which are suitable with respect to the spirit of the invention.

Any discussion of the prior art throughout the specification should in no way be considered as an admission that such prior art is widely known or forms part of the common general knowledge in this field.

In the present specification and claims (if any), the word "comprising" and its derivatives including "comprises" and "comprise" include each of the stated integers but does not exclude the inclusion of one or more further integers.

Dimensions of certain parts shown in the drawings may have been modified and/or exaggerated for the purposes of clarity or illustration, and are not limiting to the scope of the invention.

Although the invention has been described with reference to specific examples, it will be appreciated by those skilled in the art that the invention may be embodied in many other forms, in keeping with the broad principles and the spirit of the invention described herein.

The present invention and the described preferred embodiments specifically include at least one feature that is industrial applicable.

The invention claimed is:

1. A device for cleaning a swimming pool, the device comprising;

a base member, the base member having a first base portion and a second base portion;

a socket disposed on the base member;

the first base portion and the second base portion each respectively having a hinge end and a distal end;

the second base portion hinge end is attached to the first base portion hinge end forming a hinge of the base member;

a microfibre cloth removably mountable to the base member; and wherein the second base portion is configured to move between a first position and a second position, in which the first position is an operating position and the second position is a cloth removal position; wherein the microfibre cloth further comprises a tab passing between the socket and the base to releasably secure the microfibre cloth to the base member.

2. The device as claimed in claim 1, wherein the hinge ends are offset relative to the socket.

3. The device as claimed in claim 2, wherein the base member comprises an array of apertures.

4. The device as claimed in claim 1, wherein the tab further comprises at least one of; a buckle and hook and loop fasteners.

5. The device as claimed in claim 4, wherein the second base portion is restricted to rotating in a direction toward a contact surface.

6. The device as claimed claim 5, wherein the distal end of at least one of the first base portion and the second base portion is curved upwardly.

7. The device as claimed in claim 6, wherein the at least one distal end curved upwardly fits the contours of a swimming pool.

8. The device as claimed in claim 7, wherein the base comprises a locking means to retain the base in the first position.

9. The device as claimed in claim 8, wherein the microfibre cloth comprises a plurality of microfibre tufts.

10. The device as claimed in claim 9, wherein the microfibre cloth comprises a pocket adapted to receive a distal end of the base member.

11. The device as claimed in claim 10, wherein a handle is disposed on the second base portion to actuate the hinge.

12. The device as claimed in claim 11, wherein the socket is adapted to receive a pole.

13. The device as claimed in claim 12, wherein the socket is pivotally attached to the base member.

14. The device as claimed in claim 13, wherein the socket is attached to the first base portion.

15. A device for cleaning a swimming pool, the device comprising;

a base member, the base member having a first base portion and a second base portion;

a socket disposed on the base member;

the first base portion and the second base portion each respectively having a hinge end and a distal end;

the second base portion hinge end is attached to the first base portion hinge end forming a hinge of the base member;

a microfibre cloth removably mountable to the base member; and wherein the second base portion is configured to move between a first position and a second position, in which the first position is an operating position and the second position is a cloth removal position, wherein the base member comprises an array of apertures; wherein the microfibre cloth further comprises a tab passing between the socket and the base to releasably secure the microfibre cloth to the base member.

16. The device as claimed in claim 15 wherein the distal ends of the base member are relatively rounded in shape to allow for cleaning of contours of a swimming pool.

17. The device as claimed in claim 16 wherein the base member is formed from a polymer and the distal ends of the base member are contoured with apertures to allow for easier movement in a submerged environment.

18. The device as claimed in claim 17 wherein a surface of the microfibre cloth comprises removable attachment means.

19. The device as claimed in claim 18 wherein the removable attachment means comprises a strap attached to the tab of the microfibre cloth for engaging the base member.

* * * * *